US005791318A

United States Patent [19]

Schulz et al.

[11] Patent Number: 5,791,318

[45] Date of Patent: Aug. 11, 1998

[54] VALVE FOR THE METERED INTRODUCTION OF FUEL VAPOR EVAPORATED FROM A FUEL TANK OF AN INTERNAL COMBUSTION ENGINE

[75] Inventors: Wolfgang Schulz, Bietigheim-Bissingen; Georg Mallebrein, Singen, both of Germany

[73] Assignee: Robert Bosch GmbH, Stuttgart, Germany

[21] Appl. No.: 860,046

[22] PCT Filed: Jun. 26, 1996

[86] PCT No.: PCT/DE96/01120

§ 371 Date: Jun. 24, 1997

§ 102(e) Date: Jun. 24, 1997

[87] PCT Pub. No.: WO97/16640

PCT Pub. Date: May 9, 1997

[30] Foreign Application Priority Data

Oct. 27, 1995 [DE] Germany ..... 195 40 021.6

[51] Int. Cl.[6] ..... F02M 33/02

[52] U.S. Cl. ..... 123/520; 123/458; 251/205; 251/129.07

[58] Field of Search ..... 123/458, 519, 123/520, 518, 516, 521; 251/129.07, 205

[56] References Cited

U.S. PATENT DOCUMENTS

| | | | |
|---|---|---|---|
| 2,764,995 | 10/1956 | Krupp | 251/205 |
| 3,080,885 | 3/1963 | Webster | 251/205 |
| 4,195,814 | 4/1980 | Kimata | 251/205 |
| 4,471,942 | 9/1984 | Kocanowski | 251/205 |
| 4,621,604 | 11/1986 | Abthoff | 123/446 |
| 4,832,312 | 5/1989 | Linder | 251/129.07 |
| 5,199,404 | 4/1993 | Cook | 123/520 |
| 5,205,537 | 4/1993 | Pfeiffer | 251/205 |
| 5,524,593 | 6/1996 | Denne | 123/520 |
| 5,535,725 | 7/1996 | Baker | 123/520 |

*Primary Examiner*—Carl S. Miller

*Attorney, Agent, or Firm*—Edwin E. Greigg; Ronald E. Greigg

[57] ABSTRACT

A valve is provided for a metered introduction of fuel vapor evaporated from a fuel tank of an internal combustion engine into an intake tube of the engine. A valve housing which has an inflow fitting for connection to a ventilation fitting of the fuel tank or an adsorption filter for evaporated fuel vapors. The valve housing is connected to the fuel tank and has an outflow fitting for connection to the intake tube. An armature is provided inside the valve housing in which the armature is moved by an electromagnet and which is pressed against a valve seat by a valve spring when the electromagnet is without current. The armature closes a metering opening of a flow connection from the inflow fitting to the outflow fitting, and opens this flow connection to a greater or lesser degree when the electromagnet is supplied with current, wherein the metering opening has a V-shaped cross sectional area for improved metering. The valve according to the invention is suited for introducing fuel vapor evaporated from a fuel tank of a mixture compressing internal combustion engine with externally supplied ignition into an intake tube of the engine.

13 Claims, 2 Drawing Sheets

VALVE FOR THE METERED INTRODUCTION OF FUEL VAPOR EVAPORATED FROM A FUEL TANK OF AN INTERNAL COMBUSTION ENGINE

PRIOR ART

The invention is based on a valve for a metered introduction of fuel vapor evaporated from a fuel tank of an internal combustion engine into an intake tube of the engine. A valve of this kind has already been disclosed (European Patent 0 528 849), which is supplied with fuel vapor via an inflow fitting in order to be able to deliver this vapor into the intake tube in a metered fashion via an outflow fitting provided on the valve. The inflow fitting of the valve is connected, for example, via a hose to an adsorption filter, which temporarily stores the fuel vapor evaporated from the fuel tank. The valve is embodied so that it can be electromagnetically actuated and for this purpose, has a magnetic armature, which can be axially moved counter to the force of a valve spring by the magnetic forces of an electromagnet. When the electromagnet is without current, an end region of the armature, which is embodied as a valve closing member, is pressed against a valve seat in order to interrupt a flow connection from the inflow fitting to the outflow fitting. When current is supplied, the armature moves counter to the force of the valve spring and with its end region that is embodied as a valve closing member, lifts up from the valve seat, wherein a metering opening is unblocked at the outflow fitting so that a particular volume of fuel vapor can flow from the inflow fitting via the outflow fitting and into the intake tube.

The triggering of the electromagnet of the valve is carried out by means of a so-called pulse width modulated signal, which is composed of a pulse train of an electrical current that flows through the exciting coil of the electromagnet with a constant frequency. For triggering purposes, the pulse duration of the individual current pulses is increased or decreased by means of control electronics in order to thus obtain a continuously changeable attraction of the electromagnet to the armature. In the course of this, a particular axial position of the armature automatically adjusts itself as a function of the pulse duration of the individual pulses, in which position the armature pauses in order to deliver a particular volume of fuel vapor via the metering opening into the outflow fitting as a result of a throttling of the flow at the metering opening that is a function of the axial position of the valve closing member of the armature. The magnetic force of the electromagnet is a function of the pulse duration of the individual current pulses and is determined by the so-called pulse duty factor. The pulse duty factor indicates the quotient of the pulse duration divided by the pulse spacing (period duration) of the individual pulses. Due to friction effects and spring forces, the armature lifts up from its valve seat only after a particular pulse duty factor is reached, which is also called the opening pulse duty factor. Hysteresis effects result in the fact that the opening pulse duty factor can change with each renewed triggering so that a precise metering of extremely small volumes of fuel vapor has not been possible up to this point with a valve of this kind. Furthermore, the winding resistance of the exciting coil of the electromagnet is temperature dependent so that the opening pulse duty factor is also a function of temperature. It is therefore necessary to trigger the electromagnet by means of a current-regulated output stage, which prepares a pulse width modulated current signal. It is known, though, that a current-regulated output stage of this kind is relatively costly to produce in a vehicle that is equipped in the normal fashion with a direct current source.

The continuously functioning valve described delivers a flow of fuel vapor that increases in an essentially linear fashion with the rising pulse duty factor. However, the linear character of the valve described makes the metering of extremely small volumes of fuel vapor difficult when there is a relatively low pulse duty factor. In the prior art recited, the attempt is therefore made to compensate for this disadvantage by means of a second, vacuum actuated valve. The second, vacuum actuated valve is disposed parallel to the first, electromagnetically actuatable valve and when a particular vacuum is achieved in the intake tube, opens in order to introduce more fuel vapor into the intake tube. However, a system of this kind, which is comprised of two valves, is expensive. Furthermore, the valve combination indicated requires a long switch-off time in order to interrupt the delivery of fuel so that a sensitive adjustment of the fuel vapor volume fed into the intake tube per unit time is hardly possible in various operational states of the engine.

ADVANTAGES OF THE INVENTION

The valve according to the invention has the advantage over the prior art of a simple design and an excellent ability to meter small quantities.

Advantageous improvements of the valve are possible by means of the measures taken hereinafter. A pressure compensation connection embodied in the valve is particularly advantageous and permits the fuel vapor flow delivered by the valve to be metered independently of the vacuum prevailing in the intake tube. Another advantage is a compensation of the temperature dependence of the exciting coil of the electromagnet, which permits a costly current-regulated output stage to be eliminated and replaced by a triggering device with which voltage pulses that preferably have a relatively high frequency can be supplied to the exciting coil in order to permit a particularly sensitive metering of the fuel vapor volume. It is also particularly advantageous to embody the metering opening in the valve particularly so that it imparts an exponential characteristic opening curve to the valve in order to minimize the absolute error in the small quantity range. Moreover, the exponential characteristic opening curve counteracts errors based on hysteresis effects thus permitting a further improvement of the valve's ability to meter small quantities.

BRIEF DESCRIPTION OF THE DRAWINGS

Exemplary embodiments of the invention are shown in simplified fashion in the drawings and are described in detail in the description below.

DESCRIPTION OF THE EXEMPLARY EMBODIMENTS

Figure 1:
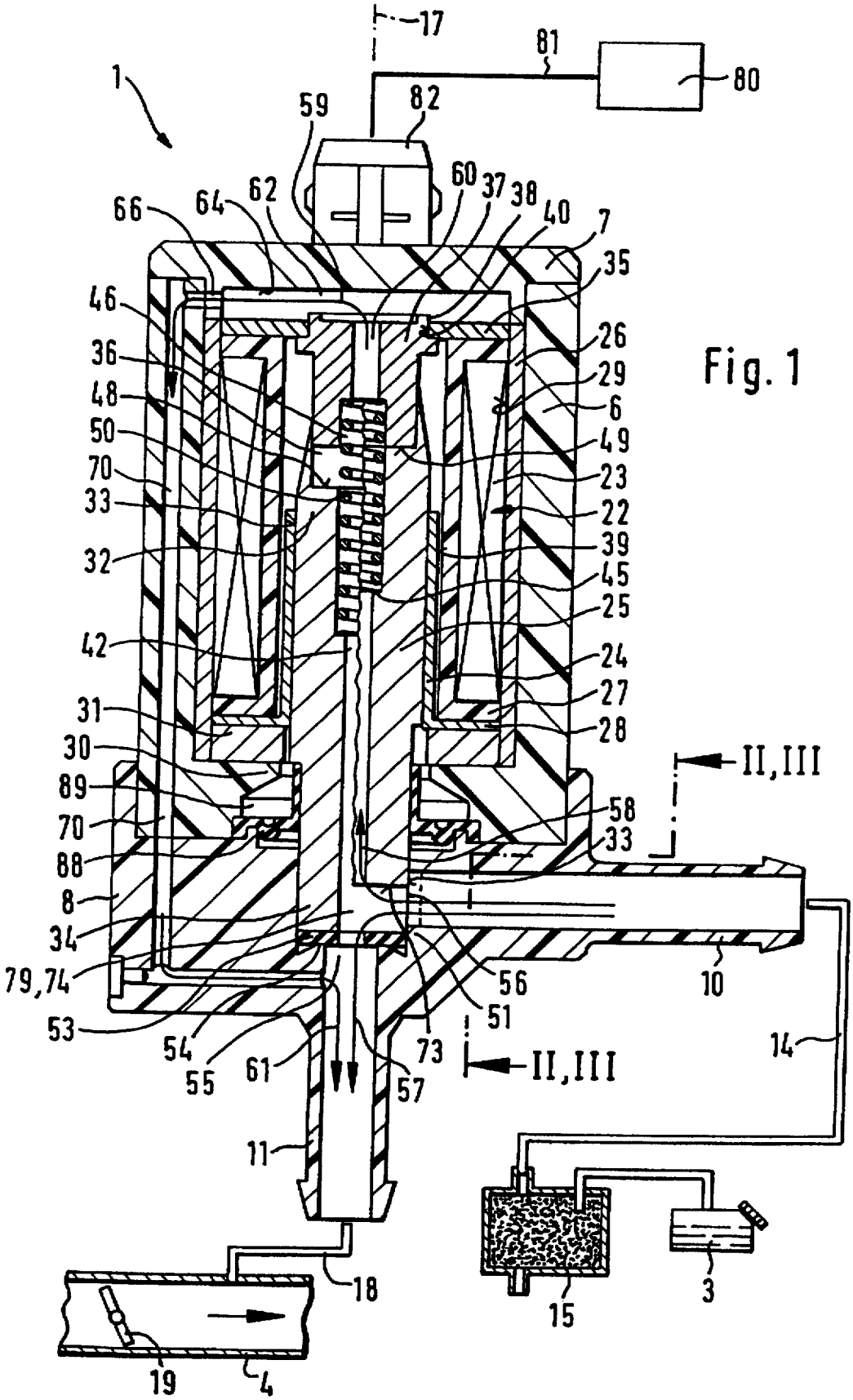
FIG. 1 shows a longitudinal section through a valve embodied according to the invention.

The valve 1 shown in a longitudinal section in FIG. 1 is used for the metered introduction of fuel vapor evaporated from a fuel tank 3 of an internal combustion engine, not shown in detail, in particular a mixture compressing engine with externally supplied ignition, into an intake tube 4 of the engine. The valve 1 is part of a fuel vapor retention system of the engine, whose mode of operation can be inferred for example from the reference Bosch Technische Unterrichtung, Motormanagement Motronic [Bosch Technical Instruction, Motor Management and Engine Electronics], second edition, August 1993, pp. 48 and 49.

The valve 1 has a valve housing made up of for example three parts, which housing is comprised of a cylindrical main housing 6, a housing cover 7 that can be placed on the main housing, and a lower housing part 8. The cylindrical main housing 6, the housing cover 7, and the lower housing part 8 are preferably made of plastic, for example using the plastic injection molding technique. The lower housing part 8 has an inflow fitting 10 and an outflow fitting 11. The inflow fitting 10 is used for connecting the valve 1, for example via a first hose 14, to the fuel tank 3 or, as shown in FIG. 1, to an adsorption filter 15 connected to the fuel tank 3. The adsorption filter 15 is filled with a storage medium for fuel vapor, in particular activated charcoal, and is used for temporarily storing fuel vapors evaporated from the fuel tank 3. The outflow fitting 11 extends for example in the axial direction from the lower housing part 8 along a longitudinal axis 17 of the valve 1 and is provided for the connection of a second hose 18. The second hose 18 feeds into the intake tube 4 for example downstream of a throttle valve 19 accommodated so that it can rotate in the intake tube 4. The inflow fitting 10 extends for example laterally to the longitudinal axis 17 of the valve 1 and protrudes radially from the lower housing part 8.

An electromagnet 22 is accommodated in a magnet housing 26 inside the main housing 6 and has a cylindrical exciting coil 23 and a magnet core 37. The magnet housing 26 is embodied as sleeve-shaped and on its inside, carries the exciting coil 23, which is wound on a coil carrier 27 comprised for example of plastic. The exciting coil 23 encloses an armature 25 of the valve 1, which armature is preferably made of metal and can be attracted by magnetic forces in order for it to be moved counter to the force of a valve spring 50 when the exciting coil 23 is supplied with current. To this end, the armature 25 is supported so that it can move axially in a guide sleeve 24 accommodated in the main housing 6. The coil carrier 27 is accommodated on the inside of the main housing 6, spaced radially apart from an outer face 39 of the guide sleeve 24, which is smaller in diameter, and the carrier extends radially to an internal wall 29 of the magnet housing 26. The radial spacing of the coil carrier 27 from the outer face 39 of the guide sleeve 24 thus prevents the armature 25 from jamming as a result of thermal expansions, for example of the exciting coil 23. The coil carrier 27 rests axially against an annular shoulder 28 of the guide sleeve 24. The shoulder 28 of the guide sleeve 24 likewise extends radially to the inner wall 29 of the magnet housing 26. For example, another contact disk 31 is accommodated between the shoulder 28 of the guide sleeve 24 and a circumferential bridge 30 of the main housing 6, which contact disk is disposed spaced radially apart from an outer face 33 of the armature 25.

To limit the maximal displacement of the armature 25, it has a recess 36 on its end 32 oriented toward the housing cover 7, which recess is embodied for example as cylindrical and at least partially encompasses the magnet core 37, which is embodied as sleeve-shaped. When the armature 25 is maximally displaced, it stops in the recess 36 with its annular bottom face 48 against an annular face 49 of the magnet core 37. In order to permit an adjustment of the maximal stroke of the armature 25, the magnet core 37 can be embodied as axially movable. To this end, the magnet core 37 has, for example, an externally threaded section 38, which engages in an internal thread 40, which is provided in a magnet bottom 35 that covers the sleeve-shaped magnet housing 26, in order to correspondingly move the magnet core 37 axially by means of rotating the magnet core 37 so that there is an adjustable armature stop for the armature 25.

The armature 25 is embodied as a hollow cylinder and has a through opening 42, which extends axially from the recess 36 on the end 32 of the armature 25 shown on top in FIG. 1, to its end 34 disposed in the lower housing part 8. A circumferential shoulder 45 is embodied in the through opening 42 and radially enlarges this through opening 42 in order to contain the valve spring 50 between the shoulder 45 and a recess 46 provided in the sleeve-shaped magnet core 37. The valve spring 50 is supported on one end in the recess 46 on the magnet core 37 and on the other end against the stop 45 in the through opening 42 of the armature 25. When the exciting coil 23 is without current, the valve spring 50 presses the armature 25 with its end 34 sealingly against an annular valve seat 54, which is covered by an annular sealing ring 53, thus closing a flow connection 74 from the inflow fitting 10 to the outflow fitting 11. The valve seat 54 is provided on an end 55 of the outflow fitting 11 disposed inside the lower housing part 8 and, as shown in the half of the valve 1 disposed on the left of the longitudinal axis 17, can be sealingly closed by the armature 25. To this end, the sealing ring 53 is comprised of an elastic material, for example rubber.

When the exciting coil 23 is supplied with current, the magnetic forces of the electromagnet 22 attract the magnetic armature 25 to the magnet core 37 in a different manner and the magnetic armature 25 assumes each axial intermediary position and, as shown in the half of the valve 1 disposed on the right of the longitudinal axis 17, as an end position, assumes its maximal open position in which the annular bottom surface 48 of the recess 36 of the armature 25 rests against the annular face 49 of the magnet core 37. In the upward movement of the armature 25 toward the magnet core 37, the armature opens a metering opening 56 on the circumference with its outer face 33, which metering opening 56 is provided running parallel to the longitudinal axis 17 on an end 51 of the inflow fitting 10, which end is disposed in the main housing 6, so that, as indicated by an arrow 57 drawn in FIG. 1, fuel vapor travels from the inflow fitting 10 through the metering opening 56, and into a chamber 79 defined between the valve seat 54 and an end face 73 of the armature 25, in order to subsequently flow into the outflow fitting 11 via the valve seat 54.

As indicated by an arrow 58 drawn in FIG. 1, a smaller part of the fuel vapor enters the through opening 42 of the armature 25 in order to travel from this opening into the recess 46 of the magnet core 37 and, via an opening 60 that continues in the magnet core 37, travels into a chamber 62, which is sealed off from the ambient air by an inner wall 64 of the housing cover 7, the magnet core 37, and the magnet bottom 35 of the magnet housing 26. The fuel vapor then travels from the chamber 62 via an opening 66 provided in the housing cover 7 into a pressure compensation connection 70, which is provided in the main housing 6 and in the lower housing part 8, for example in the form of a bore, and feeds into the outflow fitting 11 downstream of the valve seat 54. The partial flow of fuel vapor indicated in FIG. 1 by the arrows 58, 59, and 61 flows around the valve seat 54. The main flow of fuel vapor, which flows in the direction of arrow 57 from the inflow fitting 10 to the outflow fitting 11, mixes with the partial flow of fuel vapor flowing in the direction of the arrows 58, 59, and 61, downstream of the valve seat 54, in order to then travel from the outflow fitting 11, into the intake tube 4, for example via the second hose 18.

According to the stroke of the armature 25 or the spacing of its end face 73 from the valve seat 54, the metering opening 56 is unblocked by its outer face 33 to a greater or lesser degree so that the flow of fuel vapor running from the inflow fitting 10 into the outflow fitting 11 is metered accordingly. The stroke of the armature 25 that works counter to the valve spring 50 is determined by the intensity of the magnetic field of the electromagnet 22. An electronic control device 80 is provided for triggering the electromagnet 22 and is electrically connected to the electromagnet 22 via an electrical line 81 and a plug connection 82 that is formed onto the housing cover 7 and is of one piece with it.

The electronic control device 80 sends the electromagnet 22 a triggering pulse train of an electrical voltage with a relatively high frequency of for example 100 Hertz. The control device 80 transmits the triggering pulse train with a pulse duty factor that can be changed by the control device 80. The pulse duty factor indicates in percent fashion, for example, the quotient of the pulse duration divided by the pulse spacing (period duration) of successive pulses. A triggering of this kind is known to one skilled in the art as a so-called pulse width modulation. The exciting coil 23 preferably has an excitation winding that has an almost constant resistance value independent of temperature influences of the valve 1. A temperature-compensated excitation winding of this kind can be composed for example of two windings that are comprised of different materials whose resistance values are selected so that there is a compensation of the temperature dependency of the resistance value of both windings. To this end, for example, one winding of the exciting coil 23 can be comprised of a material that has a positive temperature coefficient (PTC resistor) and the other winding can be comprised of a material that has a negative temperature coefficient (NTC resistor). With the temperature-compensated exciting coil 23, it is then possible to eliminate a so-called current-regulated output stage. In lieu of the current-regulated output stage, an output stage can thus be used which preferably supplies the electromagnet 22 with a voltage pulse train that has a relatively high frequency. A voltage pulse train of this kind can be realized in a particularly simple manner, technically speaking, for example in the form of a transistor circuit that uses the direct current source of a motor vehicle, for example the one starter battery, in order to switch correspondingly back and forth between two predetermined values, for example 12 volts and 0 volts. A voltage pulse train of this kind produces an intermediate current in the exciting coil 23, which induces a magnetic field of a particular intensity in order to move the armature 25 counter to the force of the valve spring 50, away from the valve seat 54 and into a particular axial position. The axial end position of the armature 25 is a function of the applied pulse duty factor of the voltage pulse train. If no voltage is applied to the exciting coil 23 or no current is flowing in the exciting coil 23, then the valve spring 50 presses the armature 25 against the valve seat 54. The armature 25 rests with its outer face 33 against the sealing ring 53 and in so doing, covers the metering opening 56 of the inflow fitting 10 thus interrupting a flow connection from the inflow fitting 10 to the outflow fitting 11.

Figure 2:
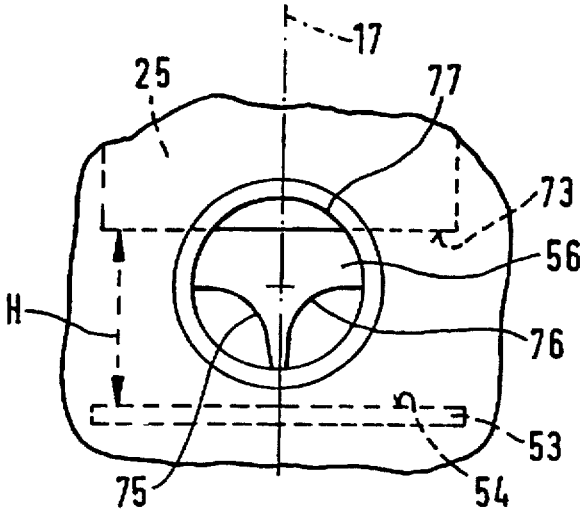
FIG. 2 shows a first section along a line II—II in FIG. 1, in accordance with a first exemplary embodiment according to the invention.

According to the invention, the metering opening 56 is embodied in the form of an orifice whose opening cross section is shaped so that an exponential characteristic opening curve is imparted to the valve 1. As shown in FIG. 2, which is a sectional view of a first exemplary embodiment according to the invention along line II—II in FIG. 1, for this purpose, the metering opening 56 is embodied as V-shaped, with a cross sectional area defined by a circular bowed section 77 and two curved cross sectional edges 75, 76, which approach each other in the direction of the valve seat 54. As likewise shown in FIG. 2, a small gap can also remain between the cross sectional edges 75, 76, in the region of their closest spacing to each other. Because of the funnel-shaped embodiment of the cross sectional edges 75, 76 of the metering opening 56, it turns out that with an increasing piston stroke H of the armature 25, a cross sectional area of the metering opening 56 is unblocked, which becomes increasingly larger and is defined by the cross sectional edges 75, 76 and the end face 73 of the armature 25, so that the volume of fuel vapor flowing through the metering opening 56 can correspondingly increase.

Figure 4:
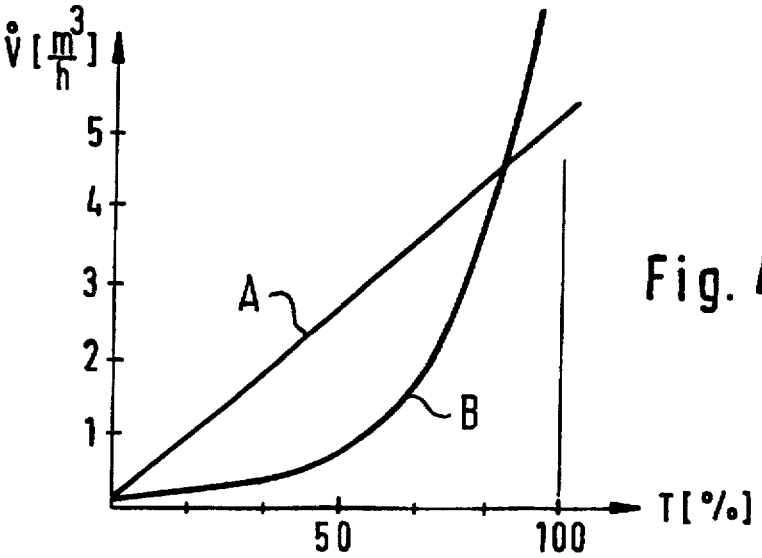
FIG. 4 is a diagram that shows the characteristic opening curve of the valve embodied according to the invention (curve B) in comparison to known valves (curve A).

As shown by curve B in FIG. 4, i.e. the characteristic opening curve of the valve 1 according to the invention, due to the embodiment of the cross sectional edges 75, 76, a valve 1 can be obtained that delivers a volumetric flow that increases for example exponentially as the pulse duty factor T rises. Since the stroke H of the armature 25 depends linearly on the pulse duty factor T of the triggering pulse train, it turns out that to reduce a relatively high volumetric flow, only a relatively small stroke path of the armature 25 is required. In particular, extremely short switch-off times of for example a few milliseconds are produced in order to reduce the volumetric flow of the valve 1 for example to zero. In the region of lower pulse duty factors (e.g. T less than 50%) a slight change of the pulse duty factor T only produces a small change of the volumetric flow, which is desirable, though, in order to obtain an excellent ability to meter small quantities in comparison to a valve that has a linear characteristic opening curve (curve A in FIG. 4). In the region of higher pulse duty factors (e.g. T greater than 50%), a slight change of the pulse duty factor T produces a relatively large change of the volumetric flow in comparison to a valve that has a linear characteristic opening curve (curve A) so that a rapid regulation of high volumetric flows is possible.

Figure 3:
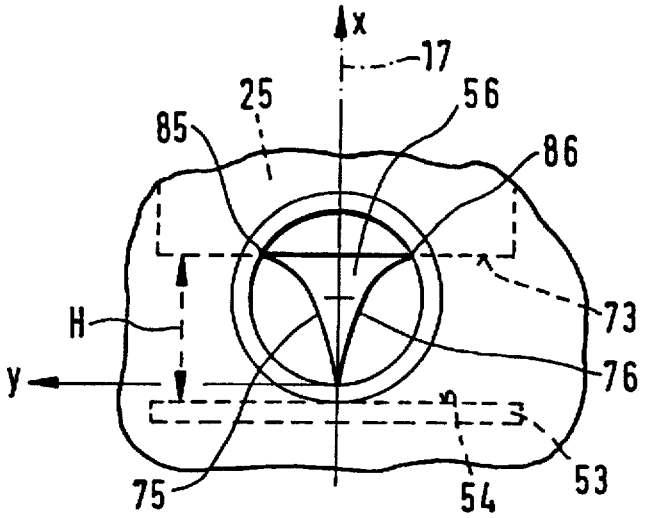
FIG. 3 shows a second section along a line III—III in FIG. 1, in accordance with a second exemplary embodiment according to the invention.

As shown in FIG. 3, which is a sectional view of a second exemplary embodiment according to the invention along line III—III in FIG. 1, the metering opening 56 can also be embodied so that the cross sectional edges 75, 76 have a curve which is of a nature that can be described by an exponential function, in particular a natural exponential function, with regard to the x, y coordinate axes that are drawn in FIG. 3 and belong to a Cartesian coordinate system with an x-axis parallel to the longitudinal axis 17. Oriented toward the valve seat 54, the cross sectional edges 75, 76 have their smallest spacing or even their point of contact, while as the spacing from the valve seat 54 increases, the distance of the cross sectional edges 75, 76 from each other grows. Because of the exponential curve of the cross sectional edges 75, 76, a further improvement of the ability of the valve 1 to meter small quantities is permitted. The maximal stroke H of the armature 25 can be adjusted in such a way that at most, the end face 73 of the armature 25 reaches end points 85, 86 of the cross sectional edges 75 or 76 with the maximal stroke, so that the armature 25 only unblocks a cross sectional area of the metering opening 56 with exponential cross sectional edges 75, 76.

Furthermore, the pressure compensation connection 70 provided in the valve housing 6, 7, 8 makes it possible for the vacuum of the intake tube 4 to prevail on both the end face 73 of the armature 25 and the opposite bottom face 48 of the recess 36 on the armature 25 when the armature 25 is lifted. Preferably the end face 73 and the bottom face 48 of the armature 25 have an engagement area of approximately the same size, by means of which a pressure compensation or force compensation is produced on the armature 25 when there are varying levels of vacuum in the intake tube so that the metering of the fuel vapor volume is independent of the vacuum prevailing in the intake tube 4. To this end, though, it is necessary to seal off the flow paths 10, 11, 42, 62, 66, 70 of the fuel vapor in the valve 1 from the ambient air, in particular in comparison to an internal chamber 89 of the electromagnet 22, which chamber is acted upon by atmospheric pressure. As shown in FIG. 1, the seal can be produced, for example, by means of a seal 88, which is embodied in the form of a sealing collar, which in the lower housing part 8, internally rests sealingly against the outer face 33 of the armature 25, for example, and is clamped on its radial outside between the main housing 6 and the lower housing part 8.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the U.S. is:

1. A valve for a metered introduction of fuel vapor evaporated from a fuel tank of an internal combustion engine into an intake tube of the engine, comprising a valve housing, which has an inflow fitting (10) for connection to a ventilation fitting of the fuel tank or an adsorption filter for evaporated fuel vapors, that is connected to said fuel tank and has an outflow fitting for connection to the intake tube of an engine, a one-piece armature including a main body (25) with an end (34) which seats on a valve seat (54), said armature is provided inside the valve housing and moved by an electromagnet, said end (34) of said armature is pressed against the valve seat by a valve spring when the electromagnet is without current, thus closing a flow connection from the inflow fitting to the outflow fitting, and the end (34) of the armature passes the inflow opening, said armature opens said flow connection when the electromagnet is supplied with current, a V-shaped cross sectional area metering opening (56) that is controlled by the armature (25) is provided between the inflow fitting (10) and the valve seat (54), the metering opening (56) has cross sectional edges (75, 76) which are embodied so that with an increasing distance of the armature (25) from the valve seat (54), an increasingly greater cross sectional area of the metering opening (56) is unblocked by the armature (25), and only once the metering opening (56) is covered by said armature (25) does the armature (25) rest on the valve seat (54).

2. A valve according to claim 1, in which the cross sectional edges (75, 76) are embodied so that they approach each other in a funnel shape in a direction of the valve seat (54).

3. A valve according to claim 2, in which the cross sectional edges (75, 76) are spaced slightly apart from each other in a region of the valve seat (54).

4. A valve according to claim 1, in which the armature (25) has a maximal stroke (H) that is calculated so that at most, the armature (25) reaches end points (85, 86) of the cross sectional edges (75, 76) with a maximal stroke (H).

5. A valve according to claim 2, in which the armature (25) has a maximal stroke (H) that is calculated so that at most, the armature (25) reaches end points (85, 86) of the cross sectional edges (75, 76) with a maximal stroke (H).

6. A valve according to claim 1, in which the cross sectional edges (75, 76) have a curve which is of a nature that can be described by an exponential function, in particular a natural exponential function.

7. A valve according to claim 1, in which the armature (25) is embodied as a hollow cylinder.

8. A valve according to claim 7, in which the valve housing (6, 7, 8) has a pressure compensation connection (70) which conveys a partial flow of fuel vapor around the valve seat (54) in the valve (1) so that when the armature (25) is lifted, a pressure prevails on both ends (32, 34) of the armature that is of essentially the same magnitude as that in the outflow fitting (11).

9. A valve according to claim 8, in which end faces (48, 73) of the ends (32, 34) of the armature (25) are of approximately the same size.

10. A valve according to claim 1, in which a guide sleeve (24) for supporting the armature (25) is accommodated in the valve housing (6) and an outer face (39) of said guide sleeve is disposed spaced radially apart from a coil carrier (27) of an exciting coil (23) of the electromagnet (22).

11. A valve according to claim 8, in which a seal (88) is provided on the armature (25), said seal (88) seals two housing parts (6, 8) of the valve (1) off from each other.

12. A valve according to claim 1, in which the electromagnet (22) has a magnet core (37) which is embodied so that the magnet core can move axially and is used as a stop for the armature (25).

13. A valve according to claim 1, in which the electromagnet (22) has an exciting coil (23) whose resistance value is virtually independent of the temperature.

* * * * *